US006904724B1

(12) United States Patent
Carrell

(10) Patent No.: US 6,904,724 B1
(45) Date of Patent: Jun. 14, 2005

(54) PILING BASED POOL SYSTEM AND METHOD

(76) Inventor: Mark Carrell, 1010 Mimosa Dr., Tallahassee, FL (US) 32312

( * ) Notice: Subject to any disclaimer, the term of this patent is extended or adjusted under 35 U.S.C. 154(b) by 129 days.

(21) Appl. No.: 10/262,246

(22) Filed: Oct. 1, 2002

(51) Int. Cl.[7] ..... E02D 27/00
(52) U.S. Cl. ..... 52/169.7; 52/169.9; 4/506
(58) Field of Search ..... 52/169.9, 169.8, 52/169.2, 169.4, 169.3, 194, 299, 296, 169.7; 4/488, 506, 498

(56) References Cited

U.S. PATENT DOCUMENTS

| | | | | | |
|---|---|---|---|---|---|
| 331,755 | A * | 12/1885 | Bailey | 52/184 |
| 2,237,272 | A | 4/1941 | Galbreath | 4/173 |
| 3,026,538 | A | 3/1962 | Boyd et al. | 4/171 |
| 3,986,309 | A * | 10/1976 | Coulter | 52/166 |
| 4,221,090 | A * | 9/1980 | Pahl | 52/169.9 |
| 4,720,949 | A | 1/1988 | Taylor | 52/169.7 |
| 4,807,418 | A * | 2/1989 | Ferguson et al. | 52/748.11 |
| 4,928,449 | A * | 5/1990 | Anderson | 52/194 |
| 5,168,675 | A | 12/1992 | Shea, Sr. | 52/64 |
| 5,638,556 | A | 6/1997 | Kipers et al. | 4/468 |
| 5,848,507 | A * | 12/1998 | Bozich | 52/299 |
| 6,374,433 | B1 * | 4/2002 | Gray | 4/498 |

* cited by examiner

*Primary Examiner*—Peter M. Cuomo
*Assistant Examiner*—Stephen Vu
(74) *Attorney, Agent, or Firm*—Peter Loffler

(57) ABSTRACT

A piling based pool system uses standard pilings, which are either pre-cast concrete, wood, or steel, etc., which pilings are drilled or driven into the ground in standard fashion with appropriate beams interconnecting the pilings. Some of the pilings are used to support a house while others of the pilings are used to hold the swimming pool shell, allowing a user to walk out of the house and use the pool without having to ascend or descend stairs. The foundation of the building as well as the swimming pool shell are each formed from a plurality of hollow core concrete panels.

20 Claims, 2 Drawing Sheets

PILING BASED POOL SYSTEM AND METHOD

BACKGROUND OF THE INVENTION

1. Field of the Invention

The present invention relates to a swimming pool that is associated with a private residence wherein the residence is located in a coastal area and the swimming pool is formed by pre-cast hollow core concrete panels supported by a piling system.

2. Background of the Prior Art

As water front living has become more and more desirable, the coastlines of various bodies of water have become ever more crowded. While living on or near the water is found by many to be an ideal way of life, placing homes proximate a body of water is not without problems. Large bodies of water such as the Atlantic ocean or the Gulf of Mexico produce hurricanes and tropical storms that can wreak havoc onto entire coastal communities. Smaller bodies of water, such as large lakes and rivers, can also produce crippling weather systems that can cause substantial damage to homes located in the vicinity. In order to protect against adverse weather systems that can impose upon buildings located in a storm's path, building techniques have been improved to help such buildings better withstand strong storms. Many such techniques are mandated by building codes and ordinances.

Modern building construction uses stronger construction materials and better construction techniques to help minimize the damage occasioned upon a building during a storm. Using 2×6 inch studs (as opposed to 2×4 studs) for structural walls, designing 2 one car garages instead of a single 2 car garage, and anchoring the roof of the building to its foundation are all examples of construction techniques that are used to help a building withstand the winds that are imposed upon the building by a fierce storm system.

In addition to constructing the building proper with advanced construction techniques, the building is also be anchored to the ground with improved techniques. The old form of construction was similar to standard residential building construction techniques. A footer-based monolithic slab was poured and served as the foundation for the rest of the building. Although this standard construction method was satisfactory for many buildings, it is not ideally suited for building on a coastline.

Although the wind produced by a severe storm can cause substantial damage to a building, oftentimes, the storm surge produced by the storm causes the bulk of the damage. Although a monolithic slab will typically not fail due to a strong wind (we have yet to see a storm that can lift several yards of poured concrete in the same way that the wind can lift a relatively lite wood and shingle roof) such a slab if subjected to a strong storm surge, especially a sustained surge that lasts several hours, can have the substrata upon which the slab is placed undermined and eventually washed away causing the slab to collapse resulting in substantial damage, if not outright collapse, of the building which is anchored to the slab.

Furthermore, the soil that is found along many coastlines tends to be less than ideal for placement of monolithic slabs. Such soils tend to have compositions that include silty and loose sands as well as peat. Even with the best compaction methods, such soil compositions tend to have unusually pronounced and relatively unpredictable settlement patterns which can cause uneven settlement of the slab. In minor situations, this can result in slab cracking which can cause cracking of rigid floor coverings such as ceramic tile. In extreme situations, a portion of the slab can settle a relatively large amount relative to the remainder of the slab, which can result in a portion of the entire building shifting, causing substantial damage to the building or even causing the building to be uninhabitable.

In order to overcome the problem with slab construction in coastal areas, pilings, such as wood pilings or pre-cast concrete pilings, are used. Such pilings are either drilled or driven into the ground below the level where loose and silty soils and peat are found and into a relatively firm soil foundation. Beams extend between the pilings and the building is built onto the beams. As the pilings are driven deep into the ground below the unstable soils, typically 20 feet or more, a powerful storm surge that wrecks havoc on the unstable soils will not unduly impact the pilings and the building thereon. While a particularly powerful storm surge may leave such a building an island, it is far easier to replace the soil around a building than to replace the building itself. Additionally, as the pilings are anchored in stable soils, soil settlement issues tend to be minimal and the building upon the pilings tends to settle within expected parameters.

Although the use of pilings protect the foundation upon which the building rests from a storm surge, the pilings do not protect the building proper from the storm surge. Accordingly, many piling-based buildings are built above the ground, with a building being built 8 feet or more above grade not uncommon. While such off grade building construction protects the building from all but the most catastrophic storm surges, it does create some inconveniences.

Many coastal residences are owned by relatively affluent people who have swimming pools. Unlike the building proper, the swimming pool is placed into the ground. As the swimming pool is much smaller than a building and as the ground itself acts as structural support for the pool, both settlement and storm surge issues with a pool tend to be muted. Additionally, it tends to be far less expensive to fix a pool than to fix the home associated with the pool. However, an in-ground pool that is associated with a pilling-based house located 8 or more feet above grade presents some very real inconveniences. Users of the pool have to descend a flight a stairs to use the pool and thereafter ascend a flight of stairs to go into the house to retrieve a cold beer, for example. While not an insurmountable problem, such ascent and descent can take some fun out of using the pool, especially for a home owner hosting a pool party who must make frequent trips between pool and house.

Therefore, there exists a need in the art for system that eliminates the inconveniences associated with an in-ground pool and a house that supported on pilings and is located above ground. Such a system must be of relatively simple design and construction.

SUMMARY OF THE INVENTION

The piling based pool system and method of the present invention addresses the aforementioned needs in the art. The piling based pool system eliminates the inconveniences associated with an in-ground pool and a house that is supported on pilings and is located above ground by allowing the placement of the pool at the same elevation as the foundation of the house that is associated with the pool. The piling based pool system is of relatively simple design and construction.

The piling based pool system and method of the present invention is comprised of a plurality of first pilings drilled or driven into the ground such that a portion of each of the first pilings is located under ground. A plurality of first beams are provided such that each first beam connects between at least a respective two of the plurality of first pilings. A swimming pool shell is secured to the plurality of first beams and the plurality of first pilings. The swimming pool shell is comprised of a plurality of hollow core concrete panels which form the sides and the base of the swimming pool shell. The plurality of first pilings and the plurality of first beams may be pre-cast concrete, cast and place concrete pilings, steel driven pilings, wood pilings, etc. A plurality of second pilings is provided and drilled or driven into the ground such that a portion of each of the second pilings is located under ground. A plurality of second beams are provided such that each second beam connects between at least a respective two of the plurality of second pilings (or a second piling and a first piling). A building is secured to the plurality of second beams and the plurality of second pilings. The building may also secured to at least some of the plurality of first beams and/or the plurality of first pilings. The building is a house. The plurality of second pilings and the plurality of second beams may be pre-cast concrete, cast and place concrete pilings, steel driven pilings, wood pilings, etc.

BRIEF DESCRIPTION OF THE DRAWING

Similar reference numerals refer to similar parts throughout the several views of the drawings.

DESCRIPTION OF THE PREFERRED EMBODIMENT

Figure 1:
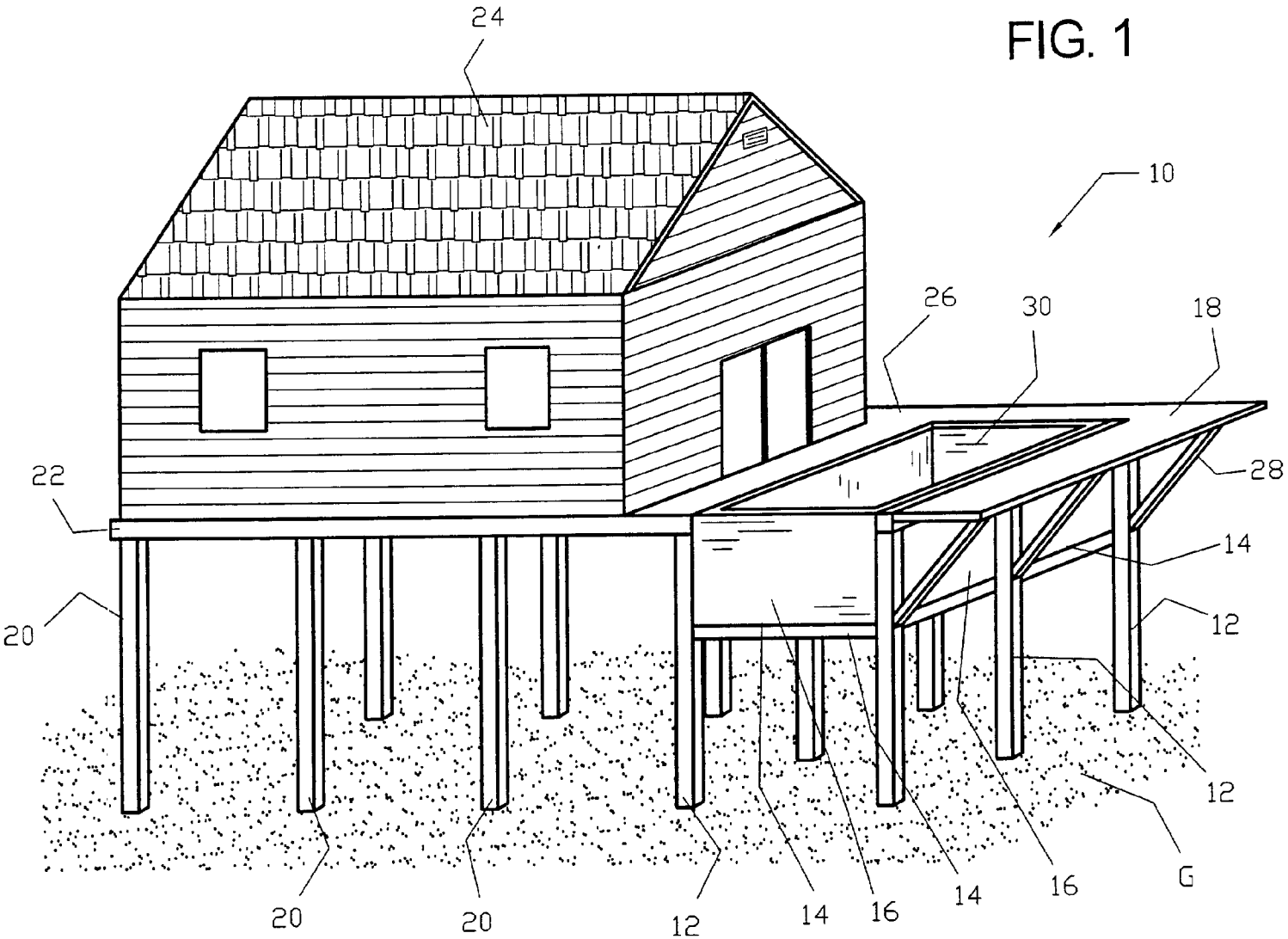
FIG. 1 is an environmental view of the piling based swimming pool system and method of the present invention.
Figure 2:
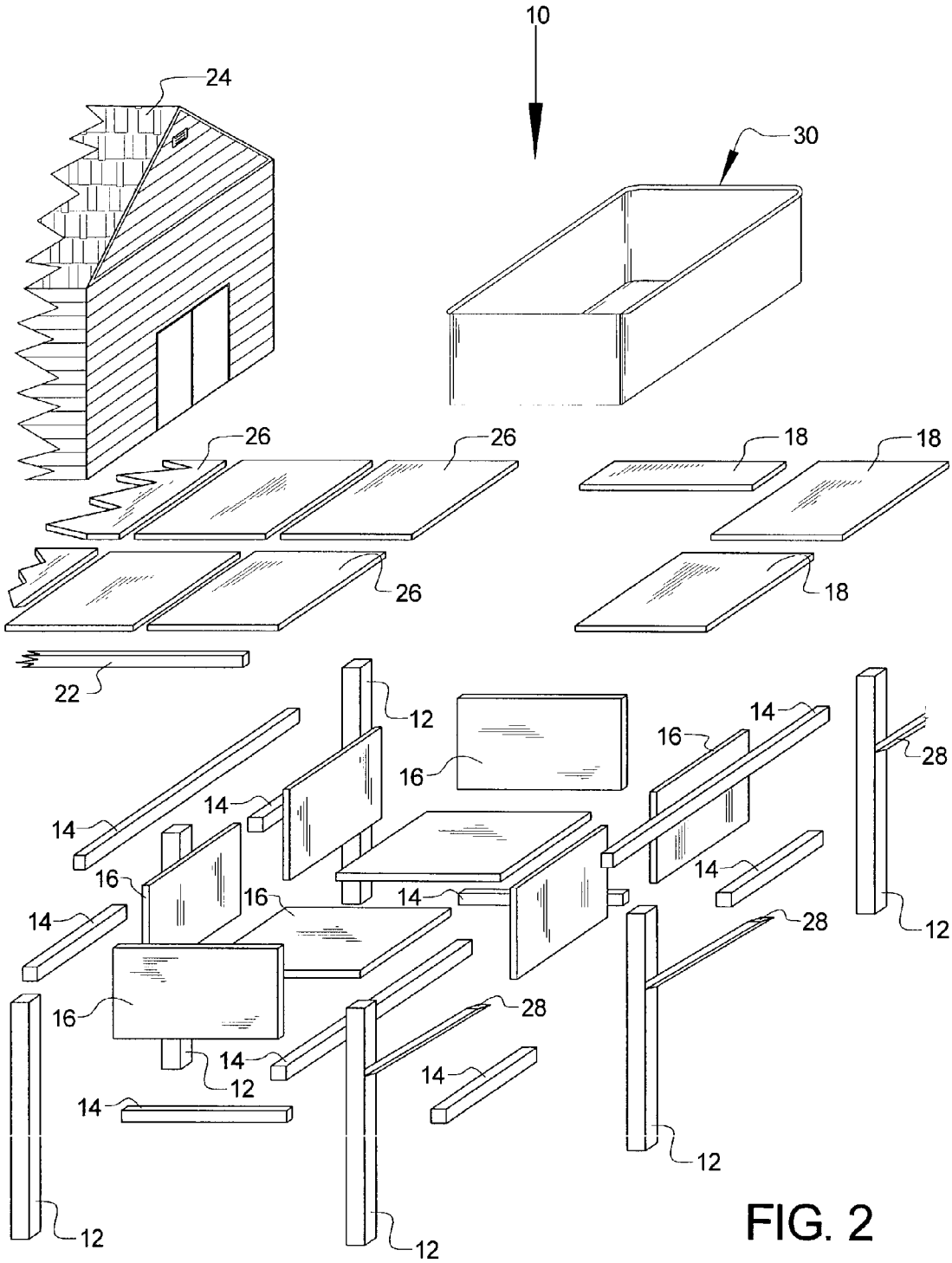
FIG. 2 is an exploded view of the piling based swimming pool system and method of the present invention.

Referring now to the drawings, it is seen that the piling based swimming pool system and method of the present invention, generally denoted by reference numeral 10, is comprised of a plurality of first pilings 12 drilled or driven into the ground G using any appropriate technique known in the art, such that a portion of each of the first pilings 12 is located under ground G. A plurality of first beams 14 are provided such that each first beam 14 connects between at least a respective two of the plurality of first pilings 12, the connection being made in any appropriate technique known in the art. A swimming pool shell is secured to the plurality of first beams 14 and the plurality of first pilings 12 in standard fashion, the swimming pool shell being made of a plurality of hollow core concrete panels 16 such that each side of the pool is made from one or more panels 16 and the base is also formed from one or more panels 16, the number of panels 16 used being dependent on the size of the pool desired, as well as the size of the individual panels 16. Each panel 16 is secured to the appropriate first pilings 12 and to adjoining panels in appropriate fashion. Once the swimming pool shell 16 is formed from the panels 16, a standard pool liner 30 (vinyl liner, fiberglass liner, etc.), is inserted into and secured within the swimming pool shell. The swimming pool shell has associated with it all appropriate swimming pool items such as a pump, a filter, a ladder, a pool light, etc., none of which are illustrated. The plurality of first pilings 12 and the plurality of first beams 14 may be pre-cast concrete, cast and place concrete pilings, steel driven pilings, wood pilings, etc. The specific size of the first pilings 12 and the depth that the pilings 12 are driven into the ground G depend on various factors including the soil composition, the number of pilings 12 used, the size of the swimming pool shell formed, the specific structure of the pilings 12 and beams 14, the amount of decking 18 which encompasses the swimming pool shell, the expected load conditions to which the system 10 is to be subjected to, etc. The swimming pool decking 18 is also formed from a plurality of hollow core concrete panels.

A plurality of second pilings 20 is provided and drilled or driven into the ground G such that a portion of each of the second pilings 20 is located under ground G. A plurality of second beams 22 are provided such that each second beam 22 connects between at least a respective two of the plurality of second pilings 20 and may also connect to some of the plurality of first pilings 12. A building 24 is built upon a foundation 26, the foundation being formed from hollow core concrete panels 16 similar to the panels 16 used to form the swimming pool shell and the deck 18 respectively. The panels 26 used to form the foundation of the building 24 are secured to the appropriate ones of the plurality of second pilings 20 and second beams 22 (and if appropriate some of the first pilings 12 and first beams 14) in appropriate fashion. The building 24 is a house. The plurality of second pilings 20 and the plurality of second beams 22 may be pre-cast concrete pilings, cast and place concrete pilings, steel driven pilings wood pilings, etc. The specific size of the second pilings 20 and the depth that the pilings 20 are driven into the ground G depend on various factors including the soil composition, the number of pilings 20 used, the size of building 24, the specific structure of the pilings 20 and beams 22, the amount of foundation 26 associated with the building 24 (the term foundation being used to encompass any decking that extends beyond the footprint of the building 24, the expected load conditions to which the system 10 is to be subjected to, etc.

In order to use the piling based pool system and method 10 of the present invention, the plurality of first pilings 12 and the plurality of second pilings 20 are each drilled or driven into the ground G as appropriate, typically under the supervision of a geo-technical engineer. The plurality of first beams 14 and the plurality of second beams 22 are connected to their respective pilings 12 and 20, as appropriate. Foundation panels 26 are provided and attached to the plurality of second pilings 20 and second beams 22 (and if appropriate some of the first pilings 12 and first beams 14) in appropriate fashion to form the foundation of the building 24 and the building 24 is built upon the foundation panels 26 in standard fashion and the swimming pool shell is formed from the swimming pool panels 16 and secured to the plurality of first pilings 12 and first beams 14. Once the swimming pool shell is formed, a liner 30 is secured within the swimming pool shell. Decking panels 18 for the swimming pool shell are secured to the first pilings 12 and the first beams 14 as appropriate and can be cantilevered thereto by appropriate braces 28. The particular configuration of the pilings 12 and 20, and the beams 14 and 22 is dependent on the particular design of the swimming pool and the building 24.

While the invention has been particularly shown and described with reference to an embodiment thereof, it will be appreciated by those skilled in the art that various changes in form and detail may be made without departing from the spirit and scope of the invention.

I claim:

1. A pool system for installation above the ground, the pool system comprising:

a plurality of first pilings, each having a first end that is drilled or driven into the ground such that a portion of each of the first pilings is located underground, each of the first pilings having a second end and a medial portion therebetween;

a plurality of first beams, connected to at least a respective two of the plurality of the first pilings at the medial portion of each of the first pilings;

a swimming pool shell, having side walls and a base, secured to the plurality of the first beams and the plurality of the first pilings, wherein the swimming pool shell comprises a plurality of hollow core concrete panels such that some of the hollow core concrete panels are attached to a pair of adjacent the first pilings and the respective first beam that connects the pair of adjacent first pilings so as to be disposed generally parallel with respect to the pair of adjacent first pilings to which the respective hollow core concrete panel is secured in order to form the side walls of the swimming pool shell and at least one of the hollow core concrete panels is disposed generally perpendicular with respect to the respective first piling to which the at least one hollow core concrete panel is attached in order to form the base of the swimming pool shell; and a swimming pool liner secured within the swimming pool shell.

2. The pool system as in claim 1 wherein the plurality of the first pilings is pre-cast concrete in construction.

3. The pool system as in claim 2 wherein the plurality of the first beams is pre-cast concrete in construction.

4. The pool system as in claim 1 wherein the plurality of the first pilings is made of wood.

5. The pool system as in claim 1 further comprising:

a plurality of second pilings drilled or driven into the ground such that a portion of each of the second pilings is located under ground;

a plurality of second beams, each of the second beams connected to at least a respective two of the plurality of the second pilings or the first pilings; and a building secured to the plurality of the second beams and the plurality of the second pilings.

6. The pool system as in claim 5 wherein the building is also secured to at least some of the plurality of the first beams or the plurality of the first pilings.

7. The pool system as in claim 5 wherein the building is a house.

8. The pool system as in claim 5 wherein the plurality of the second pilings is pre-cast concrete in construction.

9. The pool system as in claim 5 wherein the plurality of the second beams is pre-cast concrete in construction.

10. The pool system as in claim 5 wherein the plurality of the second pilings is made of wood.

11. A method for installing a pool above the ground, method comprising the steps of:

providing a plurality of first pilings;

drilling or driving the plurality of the first pilings into the ground such that a portion of each of the first pilings is located underground;

providing a plurality of first beams;

connecting each of the plurality of the first beams with at least a respective two of the plurality of the first pilings at a medial point of each of the respective first pilings;

providing a plurality of first hollow core concrete panels;

using the plurality of the first hollow core concrete panels to form a swimming pool shell having side walls and a base by attaching the swimming pool shell to the plurality of the first beams and the first pilings such that each of the hollow core concrete panels are attached to a pair of the adjacent first pilings and the respective first beam that connects the pair of the adjacent first pilings so as to be disposed generally parallel with respect to the pair of the adjacent first pilings to which the respective hollow core concrete panel is secured in order to form the side walls of the swimming pool shell and at least one of the hollow core concrete panels is disposed generally perpendicular with respect to the respective first piling to which the at least one hollow core concrete panel is attached in order to form the base of the swimming pool shell; and placing a liner within the swimming pool shell.

12. The method as in claim 11 wherein the plurality of the first pilings is hollow concrete form in construction.

13. The method as in claim 12 wherein the plurality of the first beams is hollow concrete form in construction.

14. The method as in claim 11 wherein the plurality of the first pilings is made of wood.

15. The method as in claim 11 further comprising the steps of:

providing a plurality of the second pilings;

drilling or driving the plurality of the second pilings into the ground such that a portion of each of the second pilings is located underground;

providing a plurality of second beams;

connecting each of the plurality of the second beams with at least a respective two of the plurality of the second pilings or the first pilings;

providing a plurality of the second hollow core concrete panels;

using the plurality of the second hollow core concrete panels to form a foundation and securing the foundation to the plurality of the second pilings and plurality of the second beams; and constructing a building upon the foundation.

16. The method as in claim 15 wherein the building is also secured to at least some of the plurality of the first beams or the plurality of the first pilings.

17. The method as in claim 15 wherein the building is a house.

18. The method as in claim 15 wherein the plurality of the first pilings is pre-cast concrete in construction.

19. The method as in claim 18 wherein the plurality of the first beams is pre-cast concrete in construction.

20. The method as in claim 15 wherein the plurality of the first pilings is made of wood.

* * * * *